US005362149A

United States Patent [19]

Nelson

[11] Patent Number: 5,362,149

[45] Date of Patent: Nov. 8, 1994

[54] VORTEX FINDER HIGH SHEAR MUD MIXING SYSTEM

[76] Inventor: Richard J. Nelson, 1845 Bellaire Dr., Caspar, Wyo. 82604

[21] Appl. No.: 203

[22] Filed: Jan. 4, 1993

Related U.S. Application Data

[63] Continuation-in-part of Ser. No. 743,857, Aug. 13, 1991, abandoned, which is a continuation-in-part of Ser. No. 494,412, Mar. 16, 1990, abandoned.

[51] Int. Cl.[5] ..... B01F 15/02; B01F 5/04; B01F 7/20

[52] U.S. Cl. ..... 366/165; 366/172; 366/177; 366/301

[58] Field of Search ..... 366/134, 150, 155, 165, 366/166, 167, 168, 172, 173, 177, 298, 301, 299

[56] References Cited

U.S. PATENT DOCUMENTS

| | | | |
|---|---|---|---|
| Re. 27,681 | 6/1973 | Gaddis | 366/165 |
| 461,675 | 10/1891 | Grant | 366/168 |
| 626,950 | 6/1899 | Wheelwright | 366/173 |
| 1,182,432 | 5/1916 | Stobie | 366/173 |
| 1,187,061 | 6/1916 | Gulick | 366/168 |
| 2,626,786 | 1/1953 | McGlothlin | 366/177 |
| 2,668,756 | 2/1954 | Carney | 366/172 |
| 3,244,410 | 4/1966 | Myers | 366/266 |
| 3,746,267 | 7/1973 | Myers | 241/46.11 |
| 4,175,869 | 11/1979 | Churlaud | 366/309 |
| 4,660,988 | 4/1987 | Hara | 366/137 |
| 4,779,992 | 10/1988 | Underwood | 366/137 |

*Primary Examiner*—David A. Scherbel
*Assistant Examiner*—Randall E. Chin
*Attorney, Agent, or Firm*—Henry W. Cummings

[57] ABSTRACT

A mud mixing system 10 includes a cylindrical hopper 12 having at least one upper conduit 14 with adjustable means 18 controlling a jet 16 into a vortex chamber defined between cylinders 62 and 64. At least one second conduit 20 with adjustable means 24 controlling a jet 22 emanating therefrom which is used to fill tank 12 from the bottom portion up with fresh water and/or drilling mud to shear means 30 which include a pair of vertical shafts 32 and 34, each having attached thereto at their lower portion generally horizontally extending pin shear members 36 and 38 vertically spaced apart a distance D to obtain effective shear. A table 40 to hold mud additives includes a fence 42, and a cylindrical spout 44 is used to add mud additives to hopper 12. Shafts 32 and 34 extend through chamber 66 and bearing assemblies 50 and 52 and are driven by a suitable power source 54 which may be an electric motor or combustion engine. A discharge 70 comprising a cylindrical conduit located in an opening 74 in bottom plate 76 is located inwardly from hopper wall 12 a distance sufficient to prevent unmixed, heavy portions of the mud from discharging. In the vortex 60, the heavy ends of the mud go to the outside and the light, mixed ends go to the inside of the hopper, and are discharged through the outlet after being thoroughly mixed. The gaseous material is discharged through opening 66 inside cylinder 64.

2 Claims, 3 Drawing Sheets

VORTEX FINDER HIGH SHEAR MUD MIXING SYSTEM

REFERENCE TO RELATED APPLICATION

This application is a continuation-in-part of application Ser. No. 07/743,857, filed Aug. 13, 1991, now abandoned which in turn is a continuation-in-part of application Ser. No. 07/494,412, filed Mar. 16, 1990, now abandoned.

BACKGROUND OF THE INVENTION (1) Field of the Invention

This invention relates to mud mixers for mixing mud for oil well drilling.

Vortex finders are found in desanders, desilters, and mud cleaner cones in oil-field technology. See, for example, SURFACE PRODUCTION OPERATIONS; VOL. 1; DESIGN OF OIL-HANDLING SYSTEMS AND FACILITIES; pp.100–102.

However, the vortex finder principle has not been used to obtain effective mixing and separation of the heavy and light ends in a mud mixing system.

(2) Description of Related Art

U.S. Pat. No. 4,779,992 discloses a lime shaker having a pair of shafts 28, each having horizontally extending blades 38 attached thereto. But the blades 38 extending outwardly from one shaft 36 do not overlap the blades 38 from the other shaft. Therefore less effective mixing is obtained with the design in U.S. Pat. No. 4,779,992 than with the overlapping blade construction of the present invention.

SUMMARY OF THE INVENTION

A. Objects

One object of the present invention is to achieve very efficient mud mixing in a short period of time;

Another object of the invention is to utilize the vortex finder principle in a mud mixer;

Another object is to provide a discharge system in mud mixer which avoids discharge of heavy, unmixed material.

Another object is to provide a mud mixing system in which gaseous material from the thoroughly mixed mud, is obtained from the mixer.

B. Summary

A mud mixing system 10 includes a cylindrical hopper 12 having at least one upper conduit 14 with adjustable means 18 controlling a jet 16 into a vortex chamber defined between cylinders 62 and 64. At least one second conduit 20 with adjustable means 24 controlling a jet 22 emanating therefrom which is used to fill tank 12 from the bottom portion up with fresh water and/or drilling mud to shear means 30 which include a pair of vertical shafts 32 and 34, each having attached thereto at their lower portion generally horizontally extending pin shear members 36 and 38 vertically spaced apart a distance D to obtain effective shear. A table 40 to hold mud additives includes a fence 42 and a cylindrical spout 46 is used to add mud additives to hopper 12. Shafts 32 and 34 extend through opening 66 and bearing assemblies 50 and 52 and are driven by a suitable power source 54 which may be an electric motor or combustion engine. A discharge 70 comprising a cylindrical conduit located in an opening 74 in bottom plate 76 is located inwardly from hopper wall 12 a distance sufficient to prevent unmixed, heavy portions of the mud from discharging. In the vortex 60, the heavy ends of the mud go to the outside and the light ends go the inside of the hopper, and are discharged through the outlet after being thoroughly mixed. The gaseous material is discharged through opening 66 inside conduit 64.

THE DRAWINGS

DESCRIPTION OF PREFERRED EMBODIMENTS

Figure 1:
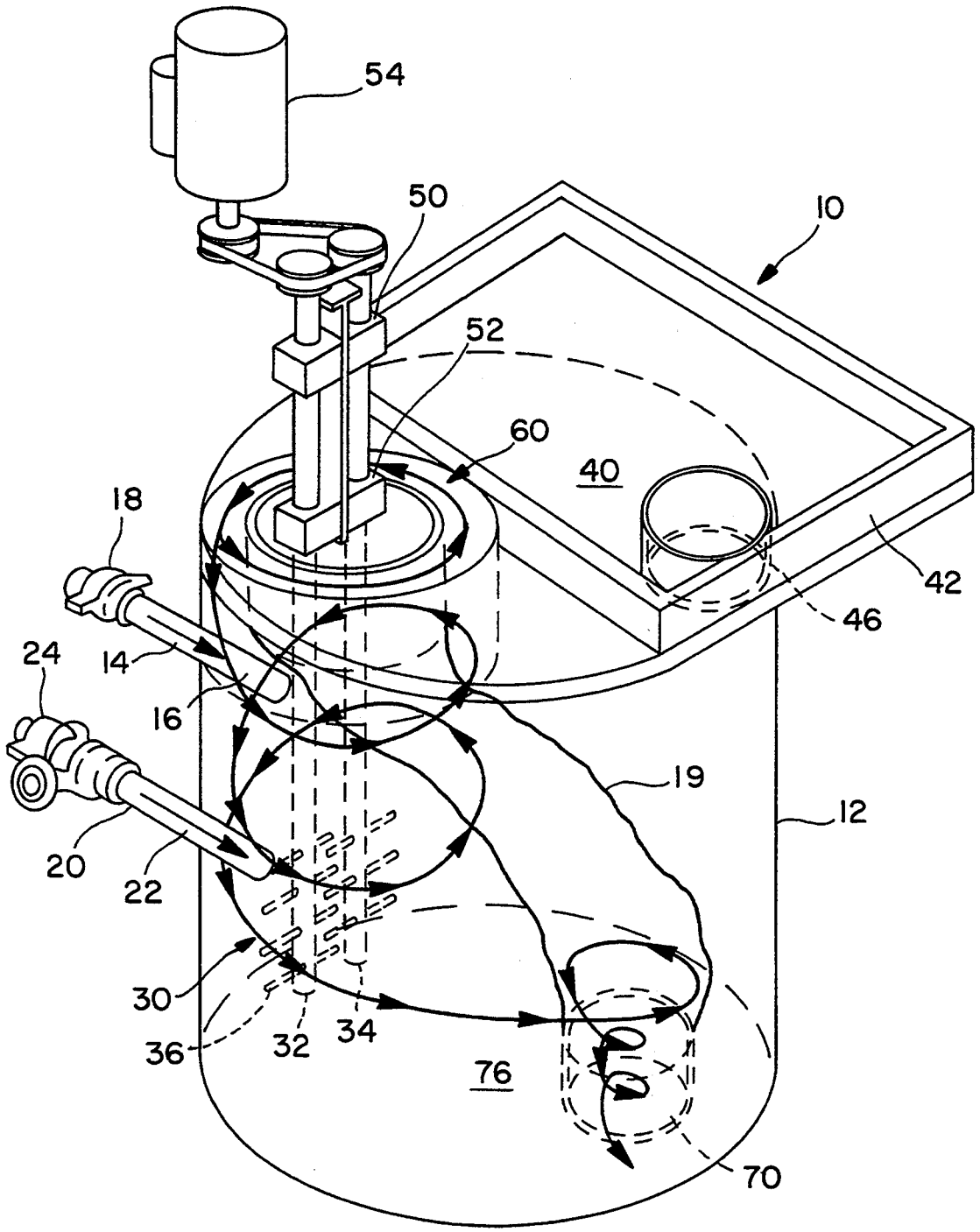
FIG. 1 is a schematic, perspective view of Vortex Finder high shear mud mixing system of the present invention.
Figure 2:
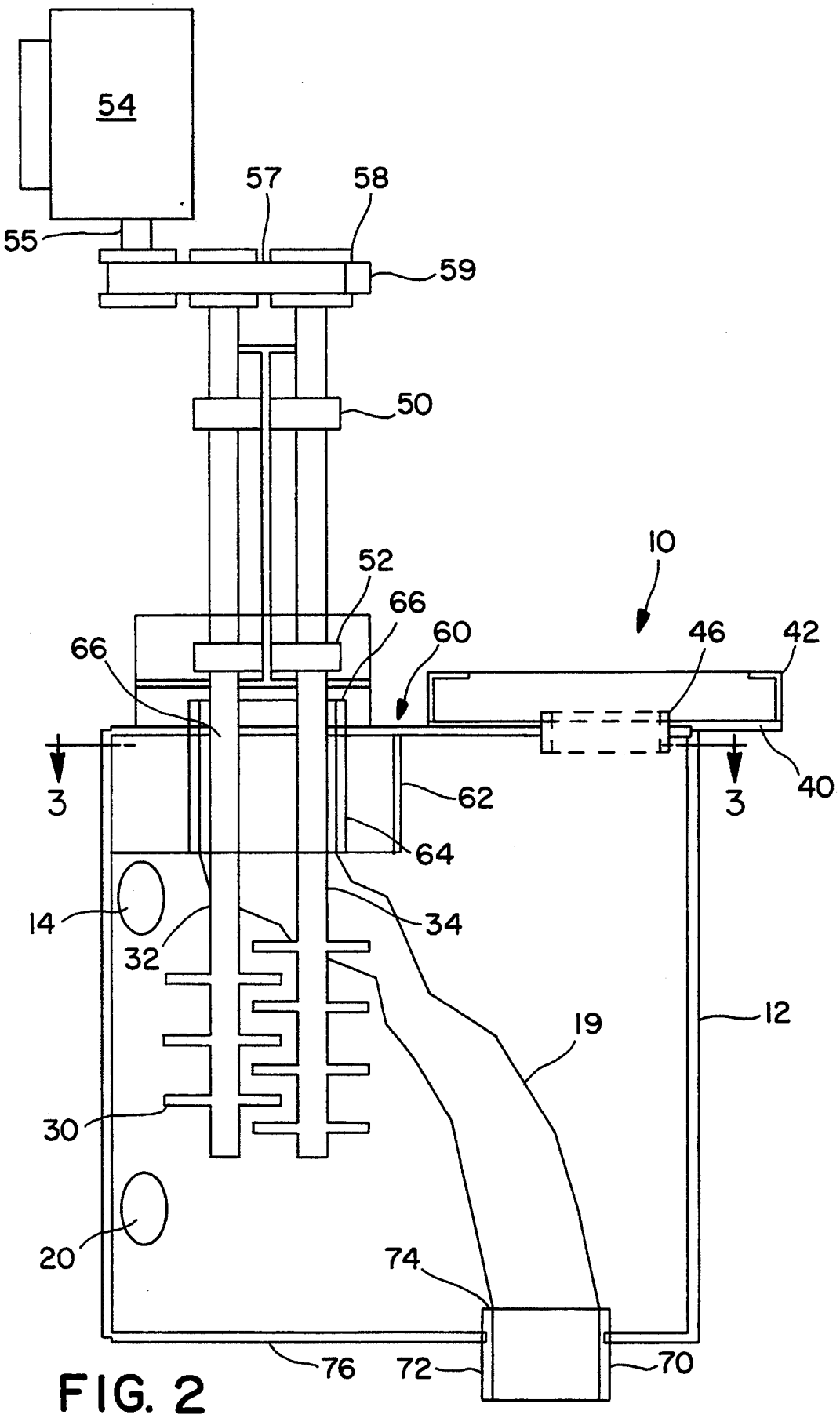
FIG. 2 is a side elevation view of FIG. 1.
Figure 3:
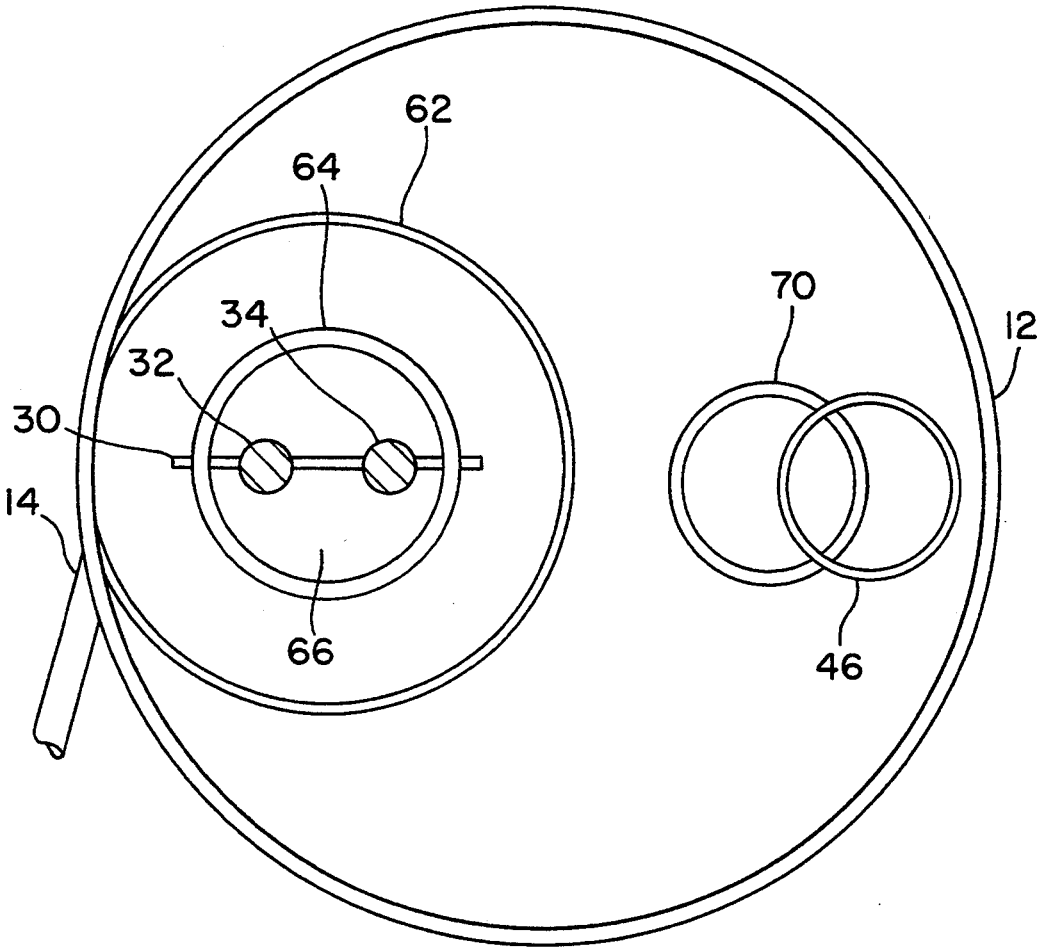
FIG. 3 is a view looking in the direction of the arrows along the line 3—3 in FIG. 2.

A mud mixing system 10 includes a cylindrical hopper 12 having at least one upper conduit 14 with adjustable means 18 controlling a jet 16 into a vortex chamber defined between cylinders 62 and 64. At least one second conduit 20 with adjustable means 24 controlling a jet 22 emanating therefrom which is used to fill tank 12 from the bottom portion up with fresh water and/or drilling mud to shear means 30 which include a pair of vertical shafts 32 and 34, each having attached thereto at their lower portion generally horizontally extending pin shear members 36 and 38 vertically spaced apart a distance D to obtain effective shear. A table 40 to hold mud additives includes fence 42 and opening 44. A spout 46 is used to add mud additives to hopper 12. Shafts 32 and 34 extend through opening 66, and bearing assemblies 50 and 52 are driven by a suitable power source 54 which may be an electric motor or combustion engine which drives a shaft 55 having on output sheave wheel 56 which drives a belt 57, which in turn drives sheave wheels 58 and 59 on shafts 32 and 34.

A discharge system for the mixer is provided. The system comprises a cylindrical conduit 72 located in an opening 74 in bottom plate 76 is located inwardly from hopper wall 12 a distance sufficient to prevent unmixed, heavy portions of the mud from discharging. In the vortex 60, the heavy ends of the mud go to the outside and the mixed ends go to the inside of the hopper and are discharged through opening 70.

The vortex 60 in the drawings is formed by the jet 16 flowing into the vortex chamber 19, where the vortex is formed. The liquid which forms this vortex flows downwardly, in a rotating contour as indicated by the vortex lines 60.

The shear means 30, including shafts 32 and 34, and horizontally extending, vertically spaced and overlapping pin shear members 36 and 38, which are offset from the center line of the hopper 12, effectively mix drilling mud injected from jet 22, and solids inserted through spout 46.

The vortex 60 insures that essentially no unmixed, heavy ends will be discharged, because the discharge means 70 is located radially inwardly from the hopper wall, where the unmixed, heavy ends are. The gaseous material rises to the top of the hopper and is discharged through opening 66. The light ends of the drilling fluid are the completely mixed fresh water and mud (bentinite, polymers) that are discharged through discharge means (70).

The heavy ends of the drilling fluid are the unmixed portions of the fresh water and mud (bentinite, polymers) held in the tank by the centrifugal action caused by the vortex chamber and the lower jets (20). The heavy ends will be passed through the shear means (30) and will become completely mixed; then turned into light ends of the drilling mud and will be discharged through the discharge means (70).

The principle of this new high shear mud mixing system is based upon the vortex finder from the desander, desilter, and mud cleaner cones common to the oilfield. As can be seen from the drawing, the discharge (70) unit is offset from the vortex finder. See *Surface Production Operations*, Volume 1, Ken Arnold and Muarice Stewart, Gulf Publishing Company.

This unique arrangement includes two important aspects to the successful operation and usage of this machine in the mud mixing and mud maintenance process for the oilfield and other related entities. The offset vortex allows the machine to provide a high volume of constantly changing fluid to surround the intermeshing shear pins rotating at 1800 rpm. Thus the fluid products are exposed to a large volume of fluid and also to a very high shear rate from the intermeshing pins 36 and 38 spaced apart ⅛th inch.

As in any vortex, the heavy ends go to the outside and the light ends to the inside. The offsetting discharge system 70 is set in from the wall of the tank to make sure, due to the centrifugal action of the tank caused by the lower jet, any unmixed, heavy ends are not allowed to exit from the tank discharge 70.

As in the standard cones used in the oilfield, gaseous material, in this case air or gas, goes to the top and is discharged at 66. While this system wasn't designed as a deaerator or degasser, a supplementary benefit is that this occurs to a significant extent in this system.

The machine adapts readily to any rig low pressure and mixing system or it can be supplied with its own charging pump. Preferably all drilling fluid additives on location run through the unit to provide a savings on these products and uniformity to the mud system.

Based on the design feature of the overlap shear members of the vortex mixer, when incorporated in shearing polymers (non-thixo tropic) drilling fluids in a homogeneous system which exhibits a psyedo plastic non-Newtonion characteristics, it provides optimum shearing which quickly enhances product incorporation. This has been illustrated on variable speed rheoneter readings, from 100–1200 RPM, for effect.

What is claimed is:

1. A mud mixing system comprising:

a cylindrical hopper having a hopper wall and at least one upper conduit with adjustable means for controlling the flow of at least one first liquid jet into an upper portion of said hopper tangentially into a vortex chamber;

said vortex chamber defined by a first cylinder located within said hopper; said cylinder being located adjacent said hopper wall and being essentially tangent to said hopper wall in the portion of said hopper wall where said first jet enters said hopper; and a second cylinder located within said hopper and positioned within said first cylinder, and being laterally spaced from said hopper wall to define a chamber between said first and second cylinders, whereby when said first jet enters the chamber between said first and second cylinders, said jet is directed into a centrifugal path by said first and second cylinders; said jet following a centrifugal path inwardly and downwardly within said hopper;

at least one second lower conduit in a lower portion of said hopper; said second conduit having adjustable means for controlling the flow of at least one second jet emanating therefrom, said second jet used to introduce fresh water and drilling mud tangentially into said centrifugal path in said hopper, whereby solid and liquid material of said fresh water and drilling mud are located within said hopper; said second jet providing additional centrifugal action in said hopper;

shear means comprising at least a pair of vertical shafts extending into said hopper; said shafts each having attached thereto at their respective distal end portions, adjacent said second jet only, generally horizontally extending pin shear members which are vertically spaced apart, and which at least partially overlap a distance sufficient to obtain effective shear mixing of said solid and liquid material to form thoroughly mixed light ends; and hopper discharge means located in said lower portion of said hopper and spaced radially inwardly from said hopper wall a distance sufficient to prevent unmixed, heavy ends of the fresh water and mud from discharging from the hopper, whereby heavy ends of the unmixed portions of the fresh water and mud go to the outer peripheral region of the hopper adjacent said hopper wall, and said thoroughly mixed light ends go inwardly and are discharged through said hopper discharge means.

2. A mud mixing system comprising:

a cylindrical hopper having a top portion, hopper wall and at least one upper conduit with adjustable means for controlling the flow of at least one first, liquid jet into an upper portion of said hopper tangentially into a vortex chamber;

said vortex chamber defined by a first cylinder located within said hopper; said cylinder being located adjacent said hopper wall and being essentially tangent to said hopper wall in the portion of said hopper wall where said first jet enters said hopper; and a second cylinder located within said hopper and positioned within said first cylinder, and being laterally spaced from said hopper wall to define a chamber between said first and second cylinders; whereby when said first jet enters the chamber between said first and second cylinders, said jet is directed into a centrifugal path by said first and second cylinders; said jet following a centrifugal path inwardly and downwardly within said hopper;

at least one second conduit in a lower portion of said hopper; said conduit having adjustable means for controlling the flow of at least one second jet emanating therefrom; said second jet used to introduce fresh water and drilling mud into said lower portion of the hopper; said second jet providing additional centrifugal action in said hopper;

loading means provided at the top portion of the hopper for introducing solid additive materials into the hopper; whereby solid and liquid material of said fresh water and drilling mud are located within said hopper;

said second cylinder providing at least one opening in said top portion of the hopper;

shear means comprising at least a pair of vertical shafts extending into said hopper; said shafts each having attached thereto at their respective distal end portions, adjacent said second jet only, generally horizontally extending pin shear members which are vertically spaced apart, and which at least partially overlap a distance sufficient to obtain effective shear mixing of said solid and liquid material to form light, thoroughly mixed ends;

hopper discharge means located in said lower portion of the hopper and spaced radially inwardly from said hopper wall a distance sufficient to prevent unmixed, heavy ends of the unmixed portions of the fresh water and mud from discharging from the hopper, whereby heavy ends of the unmixed portions of fresh water and mud go to the outer peripheral region of the hopper and the thoroughly light mixed ends go inwardly and are discharged through said hopper discharge means, and gaseous material formed by mixing is discharged at the top portion of the hopper through said opening in said top portion of said hopper.

* * * * *